US006585179B2

(12) United States Patent
Weibel et al.

(10) Patent No.: US 6,585,179 B2
(45) Date of Patent: Jul. 1, 2003

(54) CHOPPER FOR CHOPPING UP FOOD

(75) Inventors: Hans Weibel, Schupfen (CH); René Ackermann, Niederbuchsiten (CH)

(73) Assignee: Zyliss Haushaltwaren AG, Lyss (CH)

( * ) Notice: Subject to any disclaimer, the term of this patent is extended or adjusted under 35 U.S.C. 154(b) by 0 days.

(21) Appl. No.: 10/075,197

(22) Filed: Feb. 15, 2002

(65) Prior Publication Data

US 2002/0113155 A1 Aug. 22, 2002

(30) Foreign Application Priority Data

Feb. 16, 2001 (EP) ..... 01810162

(51) Int. Cl.[7] ..... B02C 18/00; B02C 18/02
(52) U.S. Cl. ..... 241/169; 241/283; 241/285.2
(58) Field of Search ..... 241/100, 168, 241/169, 264, 283, 285.2

(56) References Cited

U.S. PATENT DOCUMENTS 3,933,315 A * 1/1976 Popeil ..... 241/166
4,967,970 A * 11/1990 Michel ..... 241/169
D331,170 S * 11/1992 Greiner ..... D7/693
D414,384 S * 9/1999 Schulein ..... D7/693
6,467,711 B2 * 10/2002 Michel ..... 241/169

FOREIGN PATENT DOCUMENTS

| | | |
|---|---|---|
| DE | 935 749 | 11/1955 |
| EP | 0 345 223 | 12/1989 |
| EP | 1 027 966 | 8/2000 |

* cited by examiner

*Primary Examiner*—John M. Husar
(74) *Attorney, Agent, or Firm*—Oblon, Spivak, McClelland, Maier & Neustadt, P.C.

(57) ABSTRACT

A chopper for chopping up food has an upper portion and a push rod, displaceable therein, with an actuation head and a blade. A lower portion is connected to the upper portion, and a chopped material cup serves to receive the chopped material. Inserted in the upper portion and on the top surface of the actuation head are parts made of a material which is softer than the material of the upper portion or respectively of the actuation head. Thanks to the soft parts inserted in the upper portion, the chopper can be securely held by hand. The soft part inserted on the actuation head damps the blows exerted by hand for chopping.

8 Claims, 3 Drawing Sheets

CHOPPER FOR CHOPPING UP FOOD

Figure 1:
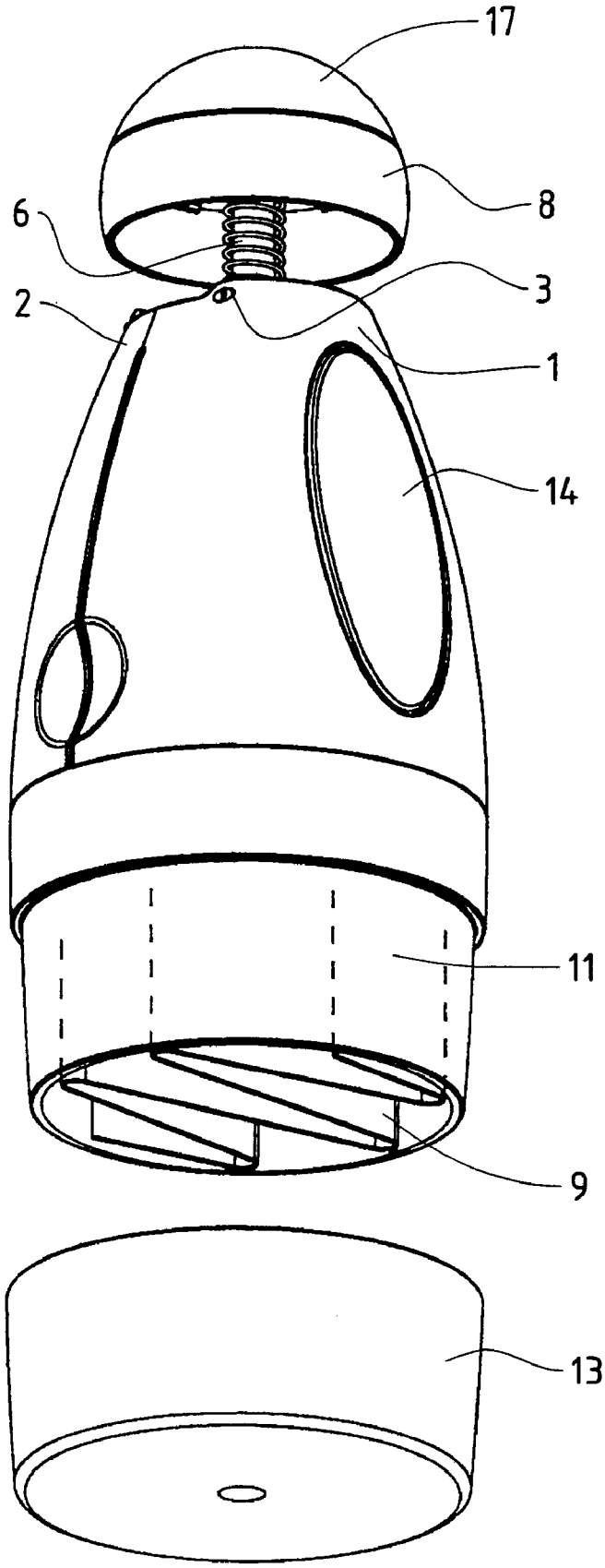

The invention relates to a chopper for chopping up food, with an upper portion, a push rod displaceable therein with an actuation head and a blade as well as a lower portion connected to the upper portion.

Choppers of this kind are known in a wide variety of design embodiments. They are used in that prepared foodstuffs, for instance peeled onions, are placed ready on a board or in a cup fitting the chopper and are then chopped up by the blade of the chopper in that the user presses or pounds on the actuation head by hand as often as necessary until the desired fineness of chopping is achieved. The chopper is thereby held with the other hand on the upper portion. Connected to the push rod is usually a mechanism that turns it a little with every stroke so that the blade strikes the material to be chopped each time at a different angle. A recuperating spring brings the push rod back into the upper starting position after each cut.

There exists a problem with these known choppers in that the actuation head can cause pains in the hand when pounding movements are carried out. Therefore actuation heads with a large surface have already been constructed to keep minimal the surface pressure affecting the hand during actuation. A further problem in many cases is the holding of the chopper on its upper portion. In particular when the user has wet hands, it can easily happen that the chopper slides out of his hand. Also the cleaning of the known choppers after use turns out to be inconvenient in many cases. If, finally, known choppers of the type described are supposed to be produced in different colors from plastic by means of injection molding methods, each color change causes a considerable expense in particular through the standstill of the respective injection molding machine and also not infrequently through the loss of the parts molded just after the color change, owing to color impurities.

With the state of the art as a point of departure, the object of the invention is to propose a chopper in which the blows exerted by hand on the actuation head during actuation are damped to the point that they do not cause any pain to the user and/or its upper portion offers such a good grip that the chopper does not slip out of the user's hand even when the hand is wet.

These aims are achieved according to the invention in that in the upper portion and/or on the top surface of the actuation head parts are inserted made of a material which is softer than the material of the upper portion or respectively of the actuation head.

Through these measures it also becomes possible to manufacture a large number of upper portions and actuation heads of a colorless or uniformly monochrome material and to give the choppers during final assembly a special look by using soft parts of a material of a different color.

The material of the parts inserted is preferably clearly softer than the material of the upper portion or respectively of the actuation head; especially preferred is a material so rubbery elastic that it can be deformed by hand. According to a preferred embodiment of the invention, the part inserted on the top surface of the actuation head has the shape of a spherical cap. If a hollow space is provided, serving as an air cushion, between the actuation head and the part with the shape of a spherical cap, the blows exerted on the actuation head by the user's hand during chopping are damped even better. The inserts in the upper portion, preferably at least two pieces, are preferably of oval shape, whereby it is possible to grasp the upper portion with one hand in an especially comfortable fashion. The parts inserted in the upper portion as well as the part placed on the actuation head preferably each have at least two attachment tabs which are received in corresponding apertures of the upper portion or respectively of the actuation head, and are firmly held therein by means of engagement protrusions provided on the attachment tabs. By means of this kind of attachment, parts inserted can be removed and put on again without the aid of tools. According to a further special embodiment of the invention, in the region of each part inserted the upper portion has one opening each which is covered over by the corresponding part. If the part inserted is removed, the interior of the chopper can be rinsed out through this opening.

The invention will be explained more closely in the following, by way of example, with reference to an embodiment example shown in the attached drawings.

Figure 2:
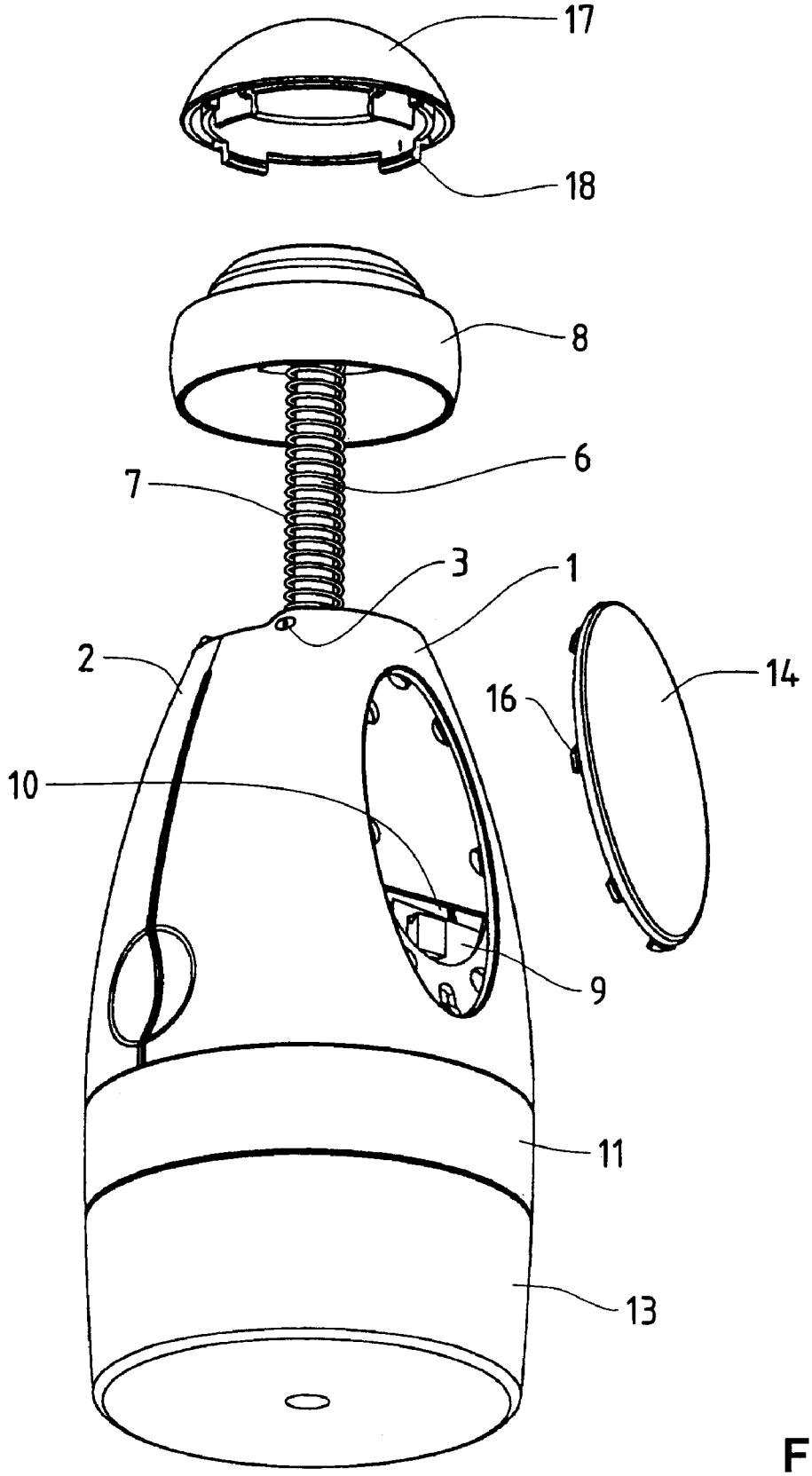
Figure 4:
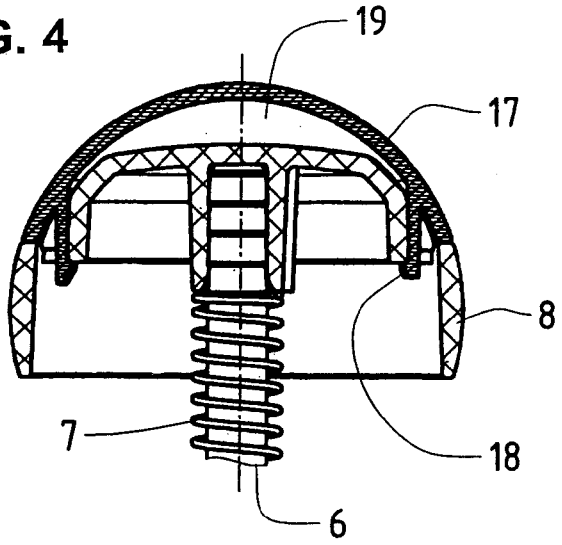
Figure 3:
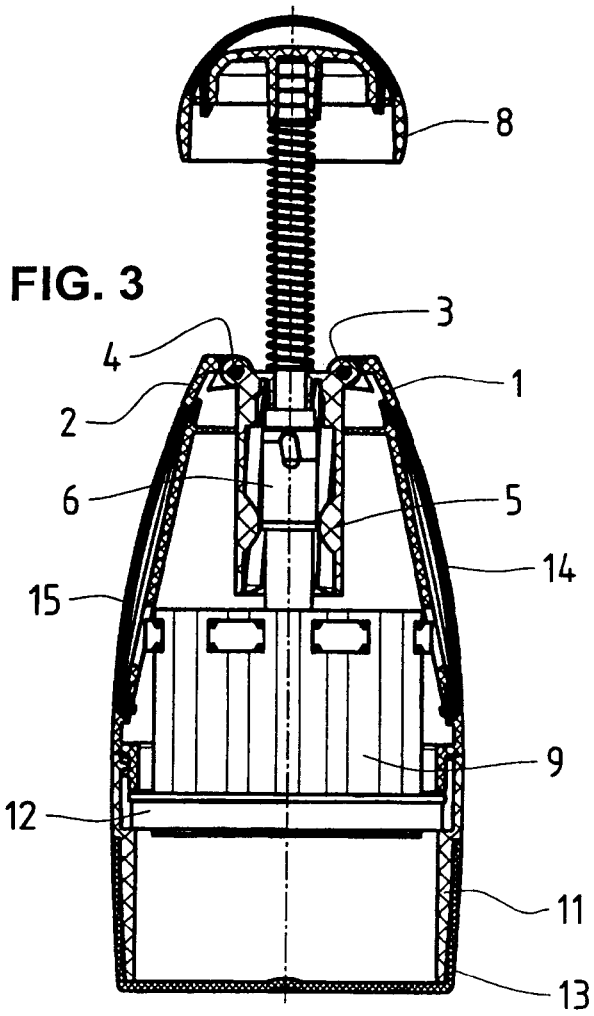
Figure 5:
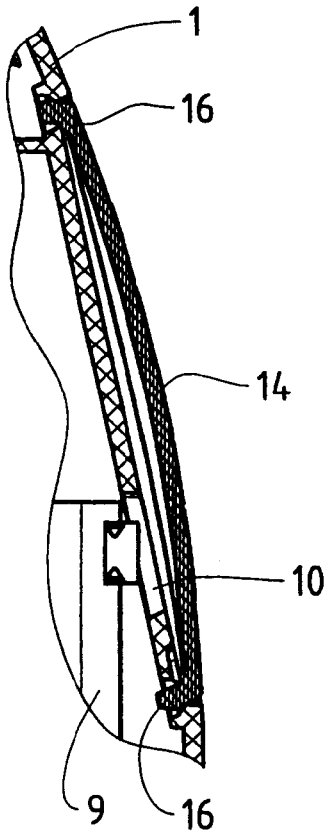

FIG. 1 shows a view in perspective of the chopper with push rod pushed down, FIG. 2 shows a view in perspective of the chopper, the insertable parts of the upper portion and of the actuation head being shown taken off, FIG. 3 shows a longitudinal section through the chopper, FIG. 4 shows the actuation head corresponding to FIG. 3 on a scale enlarged with respect to FIG. 3, and FIG. 5 shows a detail of the upper portion corresponding to FIG. 3 on a scale enlarged with respect to FIG. 3.

Shown in perspective in FIG. 1 is an embodiment example of a chopper according to the invention. The push rod 6 is pressed down in this view so that the blade 9 is visible below, which is bent in a zigzag way in this example. The upper portion of the chopper comprises two parts 1 and 2 which are pivotable upwards about hinge pins 3 and 4 (4 is visible only in FIG. 3) for cleaning purposes when the lower portion 11, which is connected to the upper portion in a bayonet-type way, is taken off. A chopped material cup 13 is shown below the chopper. Installed above on the push rod 6 is an actuation head 8. Of the inserts according to the invention, which will be described more closely later, parts 14 and 17 are visible in this figure.

FIG. 2 shows, likewise in perspective, a view of the chopper, the push rod being shown—in contrast to FIG. 1—in its upper starting position in which it is held by means of the recuperating spring 7. Shown above the actuation head 8 is a spherical cap 17 on which four attachment tabs 18 are disposed integrally. The spherical cap is fastened to the actuation head 8 in that the attachment tabs 18 engage in corresponding apertures provided in the actuation head 8 and are held firmly therein by means of engagement protrusions (see FIG. 4). The spherical cap consists of a material which is considerably softer than the material of the actuation head 8 such that the spherical cap 17 is able to be elastically deformed by hand during actuation. The flexibility of the material of the spherical cap 17 also make it possible for this cap to be removed from the actuation head 8 and to be put on again without tools. Seen in FIG. 4 in longitudinal section is the spherical cap 17 connected to the actuation head 8. A hollow space 19 between the top surface of the actuation head 8 and the spherical cap 17 is also very clearly discernible in this depiction. The air cushion resulting from this hollow space 19 supports the damping effect of the soft material of the spherical cap 17.

Attached in a similar way in the upper portion is an insert 14, which is shown taken off in FIG. 2. This insert is also produced from a soft material deformable by hand, and has attachment tabs 16, which engage in corresponding apertures of the upper portion 1 or 2 and are held firmly therein by means of engagement protrusions. In FIG. 5, which shows an enlarged detail from FIG. 3, it is clearly discernible how the attachment tabs 16 of the insert 14 sit in corresponding openings of the upper portion 1.

To be seen furthermore in FIG. 2 is that, after removal of the insert 14 in the upper portion 1, an opening 10 is exposed through which the blade 9 is visible. Through this opening 10, the interior of the chopper can be rinsed out with water. If the chopper is supposed to be cleaned more thoroughly, the two halves 1 and 2 of the upper portion can be pivoted apart, as described further above, after removal of the lower portion 11, whereby the blade 9 is then completely exposed. Present vis-à-vis the insert 14 is a same insert 15 on the other side in the upper portion 2, as is seen in FIG. 3. If the bipartite upper portion 1, 2 of the chopper is grasped with one hand, the inserts 14 and 15 yield slightly, owing to their elasticity, which considerably improves the grip on the chopper and certainly prevents the chopper from being able to slide out of the user's hand.

Visible in the middle of FIG. 3, which figure shows a longitudinal section through the described embodiment example of the chopper, is the central part 5 which receives the mechanism, mentioned at the beginning, for rotation of the blade 9 and at which the two halves 1 and 2 of the upper portion are disposed in an articulated way by means of the hinge pins 3 and 4. To be discerned in this figure furthermore is a scraper 12, through which the blade 9 projects.

Through the described construction of the chopper according to the invention it is possible to adapt in a simple way the optical appearance of the chopper to the wishes of the customer. For example, the upper portion 1, 2 and the lower portion 11, for the manufacture of which relatively complicated tools are needed, can be produced in large numbers out of a transparent plastic. With these parts the chopper can be assembled and thus made available. The inserts 14 and 15 as well as the spherical cap 17 made of a softer material can be produced in various colors and likewise made available. If need be, only a few manipulations are then necessary to provide the ready-made chopper with the inserts and spherical cap of the desired color. The spherical cap 17, the inserts 14 and 15 as well as the chopped material cup 13 each have preferably the same color.

What is claimed is:

1. A chopper for chopping up food, comprising:

an upper portion having a push rod, an actuation head and a blade displaceable in the upper portion, a lower portion connected to the upper portion, and at least one insert inserted in the upper portion, the at least one insert being made of an insert material which is softer than an upper portion material making up a remainder of the upper portion which excludes the at least one insert.

2. The chopper according to claim 1, wherein the insert material is a rubbery elastic material that is able to be deformed by hand.

3. The chopper according to claim 1, further comprising a semi-spherical-shaped cap located at an edge of a top surface of the actuation head, the semi-spherical-shaped cap being made of a cap material which is softer than an actuation head material making up the actuation head.

4. The chopper according to claim 3, further comprising at least two attachment tabs protruding from an edge of the semi-spherical-shaped cap, the at least two attachment tabs being received in corresponding apertures of the actuation head, and being held firmly therein via engagement protrusions provided on ends of the at least two attachment tabs.

5. The chopper according to claim 3, further comprising a hollow space located between the actuation head and the semi-spherical-shaped cap, the hollow space serving as an air cushion.

6. The chopper according to claim 1, wherein the at least one insert is actually two inserts inserted on opposite sides of the upper portion, and the two inserts have an oval shape.

7. The chopper according to claim 6, wherein each of the two inserts have at least two attachment tabs, each of the at least two attachment tabs being received in corresponding apertures of the upper portion and being firmly held therein via engagement protrusions provided on ends of the attachment tabs.

8. The chopper according to claim 6, wherein each of the two inserts covers a region of the upper portion in which there is an opening.

* * * * *